US007997965B2

(12) United States Patent
Veuillet et al.

(10) Patent No.: US 7,997,965 B2
(45) Date of Patent: Aug. 16, 2011

(54) AIR CONDITIONING SYSTEM

(75) Inventors: Franck Veuillet, Nievroz (FR); Eric Pitisci, Thil (FR); Patrick Fretigny, La Boisse (FR)

(73) Assignee: Carrier Corporation, Farmington, CT (US)

( * ) Notice: Subject to any disclaimer, the term of this patent is extended or adjusted under 35 U.S.C. 154(b) by 265 days.

(21) Appl. No.: 11/995,610

(22) PCT Filed: Jul. 15, 2005

(86) PCT No.: PCT/IB2005/002015

§ 371 (c)(1),
(2), (4) Date: Jan. 14, 2008

(87) PCT Pub. No.: WO2007/010314

PCT Pub. Date: Jan. 25, 2007

(65) Prior Publication Data

US 2008/0214099 A1 Sep. 4, 2008

(51) Int. Cl.
*F24F 7/06* (2006.01)

(52) U.S. Cl. ..... 454/233; 454/232; 454/261; 454/262

(58) Field of Classification Search ..... 454/233, 454/234, 228, 230, 245, 248, 187, 239
See application file for complete search history.

(56) References Cited

U.S. PATENT DOCUMENTS

| | | | | |
|---|---|---|---|---|
| 3,032,323 | A * | 5/1962 | Church | 165/213 |
| 3,965,933 | A * | 6/1976 | Beaudin | 137/875 |
| 3,977,467 | A * | 8/1976 | Northrup, Jr. | 165/65 |
| 4,203,485 | A * | 5/1980 | Zilbermann et al. | 165/217 |
| 4,298,164 | A * | 11/1981 | Post | 236/49.4 |
| 4,328,926 | A * | 5/1982 | Hall, Jr. | 236/13 |
| 4,531,454 | A * | 7/1985 | Spoormaker | 454/232 |
| 4,608,066 | A | 8/1986 | Cadwell, Jr. | |
| 4,693,173 | A | 9/1987 | Saiki et al. | |
| 6,213,867 | B1 * | 4/2001 | Yazici et al. | 454/263 |
| 6,569,010 | B1 * | 5/2003 | Miller et al. | 454/236 |
| 6,623,353 | B1 * | 9/2003 | Akhtar et al. | 454/233 |
| 7,251,953 | B2 * | 8/2007 | Wetzel et al. | 62/419 |
| 2002/0090908 | A1 * | 7/2002 | Estepp | 454/236 |

FOREIGN PATENT DOCUMENTS

JP 2000018663 A * 1/2000

OTHER PUBLICATIONS

International Search Report dated Mar. 15, 2006.

* cited by examiner

*Primary Examiner* — Steven B McAllister
*Assistant Examiner* — Brittany Towns
(74) *Attorney, Agent, or Firm* — Carlson, Gaskey & Olds, P.C.

(57) ABSTRACT

An air distribution system for an air conditioning system includes an air supply and a plurality of air distribution units. The air distribution units are arranged in a side-by-side configuration. The air supply is operably connected to at least one of the air distribution units. Each air distribution unit includes a delivery feature for delivering air from the air supply through the air distribution unit and into an adjacent air distribution unit.

14 Claims, 4 Drawing Sheets

AIR CONDITIONING SYSTEM

REFERENCE TO RELATED APPLICATIONS

This application claims priority to PCT Application No. PCT/IB2005/002015 filed on Jul. 15, 2005.

BACKGROUND OF THE INVENTION

The present invention relates to an air distribution system for an conditioning system and in particular to a system in which, preferably fresh, air is provided from an air supply.

Fan coil systems for moving and circulating air, particularly heating and/or cooling fan coil systems, typically comprise a fan and a coil arranged in a unit in which air is moved by the fan over the coil to a distribution system having ducts for distributing the conditioned air to air conditioned spaces such as offices in an office block building. Return air from the air conditioned offices passes through return ducts and back to the fan coil unit for reconditioning. U.S. Pat. No. 6,213,867 discloses an air handling system in which return air is provided to a heat exchanging unit. U.S. Pat. No. 4,298,164 discloses an air conditioning system in which air from a heat exchanger is provided to a plurality of discharge terminals.

In current buildings it is usually desirable to install a plurality of fan coil units in a separate area remote from the offices to be conditioned. Therefore a dedicated space must be provided for the fan coil units, and this is typically provided by partitioning the office space with, for example, a false wall and false ceiling behind which the fan coil units and ducts are installed. In order for the fan coil units to occupy as small an area as possible, they are usually mounted side-by-side in the dedicated space.

It is particularly desirable to provide fresh air, for example air from outside the building, to the fan coil units for mixing with the recycled conditioned air to provide better indoor air quality in the conditioned office spaces. Fresh air is provided via a fresh air inlet, typically comprising a large duct for conveying air from outside the building to the dedicated fan coil unit space. The ducted fresh air is typically provided to each fan coil unit via an air distribution unit, such as a dedicated suspension box. Therefore, the fresh air supply occupies a significant proportion of the dedicated space, particularly because fresh air from the main fresh air duct has to be supplied to each suspension box by a separate, smaller air duct per box. Therefore the dedicated space required for such an air conditioning system is large, thereby proportionally decreasing the effective area of the building available for office space.

More widespread use of air conditioning systems having fresh air supplies necessitates smaller and more compact systems and therefore it is desirable that the size and distribution of the individual components of the system be kept to a minimum.

SUMMARY OF THE INVENTION

An air distribution system, particularly for air conditioning systems including fan coil units, includes air distribution units and an air supply, for example a fresh air supply. The system has decreased dimensions compared with prior art systems and also being quicker, simpler and less expensive to construct and install.

An air distribution system includes an air supply and a plurality of air distribution units, and the air distribution units are arranged in a side-by-side configuration. The air supply is operably connected to at least one of the air distribution units, and each air distribution unit includes a delivery feature for delivering air from the air supply through the air distribution unit and into an adjacent air distribution unit.

Therefore there is provided an air distribution system that provides air from an air supply, such as a fresh air supply duct, to at least one of a plurality of air distribution units installed side-by-side with other air distribution units. The air from the air supply is delivered to each of the other air distribution units by a delivery feature provided in each air distribution unit. In this system, air can be delivered to each air distribution unit without it being necessary for each air distribution unit to have a separate ducted supply from the main air supply, thus enabling the complexity, size and cost of the air distribution system to be reduced relative to known systems.

The air distribution system further includes a plurality of fan coil units, each fan coil unit operably associated with an air distribution unit such that air can flow from each fan coil unit to its associated air distribution unit and from each air distribution unit to its associated fan coil unit. This advantageously provides an air conditioning system having a reduced complexity, size and cost compared with known air conditioning systems. Such a system is also easy to install and can be installed in separate stages, thereby allowing installation sensitive components, e.g. electrical components such as electronic controllers, to be installed after the installation site has been cleared of dirt and dust etc. Furthermore, by providing a modular system as set out above, if a unit such as the fan coil unit fails, only that unit need be removed for replacement or repair. Still further, by providing air distribution units between the fan coil units and the ducts (for supplying and returning air and for providing air from the air supply), otherwise incompatible duct shapes, sizes and orientations can be made compatible with the fan coil unit inlets/outlets. For example, due to the compactness of known fan coil unit designs, the inlet and outlet are typically rectangular, whereas standard air ducts for supplying air to and from a space to be conditioned are typically circular or oval in cross-section. Furthermore, the rectangular ducts may be generally horizontally aligned whereas the oval ducts may be generally vertically aligned. The air distribution units can advantageously allow such incompatible components to be integrated into the air conditioning system, by providing compatible connections and also suitable flow paths through the air distribution units.

Each air distribution unit includes a feature for supplying air, which has been provided to the air distribution unit from the air supply, to its associated fan coil unit. For example, the feature includes an aperture in a wall of the air distribution unit, such as a front face of the unit. The aperture may have a spigot associated therewith, said spigot for example arranged such that it protrudes into the air distribution unit. This arrangement advantageously provides a feature for delivering air from the air supply to the associated fan coil unit for conditioning and/or for mixing with previously conditioned air that has been returned to the fan coil unit. In one embodiment, the spigot further includes a feature for controlling airflow from the air distribution unit to the fan coil unit. In a preferred embodiment, an airflow controller is provided in the spigot. For example the airflow controller includes a mechanically self-balanced feature such that the airflow to the fan coil unit is fixedly controlled. Alternatively the airflow controller for example includes a motorized control feature such that the airflow to the fan control unit can be selectively controlled, for example based on the needs of the air conditioning system user. The above arrangements advantageously provide a system for distributing air from an air supply duct to a plurality of air distribution units and from each air distribution unit to an associated fan coil unit. Flow of the air from the air distribution units to the fan coil units, and therefore also from each air distribution unit to the adjacent air distribution unit is advantageously controlled by an airflow control feature disposed in at least one of the spigots disposed within the air distribution units.

In a preferred embodiment of the present invention, the air supply includes an inlet for supplying unconditioned air from a source external to the air distribution system and a duct for transferring the external, unconditioned air to the at least one air distribution unit. This is advantageous because air from an external source, for example from outside a building, may be fresher than previously conditioned air and also the concentration of bacteria and the like in recycled air can reach undesirably high levels if the recycled air is not mixed with fresh air.

In a particularly preferred embodiment of the present invention, the air supply is operably connected to only one of the plurality of air distribution units. This arrangement provides a fresh air supply which occupies the minimum amount of space. For example the air supply is operably connected to the first air distribution unit, said first air distribution unit having only one adjacent air distribution unit in the side-by-side configuration. Namely the air supply is connected to the first of a row of side-by-side air distribution units, the first air distribution unit having only one adjacent air distribution unit, this second air distribution unit having two adjacent air distribution units (i.e. the two adjacent air distribution units consisting of the first air distribution unit and a further air distribution unit on its other side) etc. By having the plurality of air distribution units arranged side-by-side, with the air supply connected only to the first air distribution unit, it is possible to fit the air distribution system into a room or space having a minimal and elongated area, for example a partition running along the length of a corridor.

In a particularly preferred embodiment of the invention, the air supply is operably connected to a first side of the first air distribution unit, said first side being opposite a second side of the first air distribution unit and the second side being operably connected by a delivery feature to an adjacent air distribution unit. In this arrangement, the depth of the air distribution system (i.e. the space occupied by the system from the rear of the units to the front of the units) is minimised, thereby keeping the space required for the system installation to a minimum. This is particularly advantageous for air distribution systems intended to be installed in, for example, office spaces where a portion of the room must be sectioned from the usable working space to house the air distribution system.

The air supply of the air distribution system can be operably connected to the air distribution unit or units in any suitable manner. For example, the air distribution system further includes a feature for providing a substantially air-tight connection between the air supply and the at least one air distribution unit. For example, the connection feature includes an insertable seal, said seal having a flange around its periphery. For example, the seal includes a resilient material. It is particularly preferred that the seal is capable of receiving the air supply feature therein in an air-tight manner and is also capable of being received in the delivery feature of the air distribution unit in an air-tight manner, the flange sealing against the side wall of the unit.

For example, the air distribution system further includes a closure feature for providing an air-tight closure for one of the delivery feature of at least one of the air distribution units. In this manner, the delivery feature of any air distribution unit not required to be operably connected to the air supply (either directly or indirectly via one or more further air distribution units) can be closed to provide an air-tight flow path through the air distribution units. In a particularly preferred embodiment, the closure feature includes a cap, the cap comprising a solid insertable portion for insertion into the delivery feature and a rim or flange around the insertable portion to seal the cap against the side wall of the unit. For example, the cap comprising a resilient material for an improved substantially air-tight seal.

Therefore, in accordance with a particularly preferred embodiment of the present invention there is provided an air distribution system further comprising a seal for providing a substantially air-tight connection between the air supply and the delivery feature of the first air distribution unit of the plurality of side-by-side air distribution units, and a cap for providing a substantially air-tight closure for the delivery feature of the last air distribution unit of the plurality of air distribution units such that a duct from the air supply through each of the air distribution units is provided.

In accordance with the present invention, the air distribution units include a delivery feature. In a preferred embodiment of the present invention, the delivery feature includes one or more apertures. Therefore in a preferred embodiment, each air distribution unit includes a plurality of apertures, the apertures for example arranged such that a first aperture is provided in a first side wall of the air distribution unit and a second aperture is provided in a second, opposite side wall of the air distribution unit. A feature is provided for sealing apertures of adjacent air distribution units. Such a sealing feature advantageously serves to reduce or eliminate air leakages between adjacent air distribution units. In a further embodiment of the present invention, the delivery feature may further include a spigot or a pair of spigots, with one spigot provided on each of a pair of opposed side walls of each air distribution unit associated with a respective aperture. Indeed, any aperture, inlet or outlet of each air distribution unit may have a spigot associated therewith. The spigots may comprise substantially cylindrical or rectangular cross-section tubes of suitable dimensions. The spigots may be substantially external (i.e. they may protrude from the air distribution unit such that they can be inserted into spigots and/or apertures of adjacent air distribution units or of a fan coil unit etc. with or without an additional sealing feature) or they may be substantially internal (i.e. they may reside substantially within the air distribution units) or they may be partially internal and partially external. For example, the air distribution units are provided with internal spigots such that the main fresh air duct of the air distribution system is integrated inside the air distribution units.

The aforementioned delivery feature provides modular air distribution units that can be placed adjacent other air distribution units of the same or of a similar construction, thereby providing an integrated air channel or duct arrangement within and through the adjacent air distribution units.

The air distribution system of the present invention is particularly suited for use with air conditioning units such as fan coil units in an air conditioning system for distributing conditioned air to office spaces or the like, where the offices may be remote from the air conditioning system. For example, therefore, the air distribution units further comprise an outlet for distributing air, for example conditioned air to and an inlet for receiving air, for example conditioned air from a space to be conditioned. For example, ducts are provided and operably connected to the outlets and inlets of the air distribution units for delivering the air to and from the space to be heated or cooled.

Therefore, in accordance with the present invention, there is provided, in a preferred embodiment at least, an air distribution unit comprising an outlet for distributing air to a space; an inlet for receiving air from the space; and a delivery feature for distributing air from an air supply through the air distribution unit and to an adjacent air distribution unit. As discussed above, this is a particularly advantageous arrangement for providing a compact air distribution unit having an integrated air supply, which is suitable for connection with a fresh air duct. In a particularly preferred embodiment of the present invention, there is provided an air conditioning unit comprising at least one air distribution unit and at least one operably associated fan coil unit, the air distribution unit including an outlet for distributing conditioned air from the fan coil unit to a space to be cooled or heated, an inlet for receiving conditioned air from the space to be cooled or heated, and a delivery feature for distributing air from an air supply through the air distribution unit and to an adjacent air distribution unit. The delivery feature may include any suitable feature, for example apertures through one or more walls of the unit and which may have spigots associated therewith.

For example, a fresh air supply is operably connected to the air distribution unit, said connection being made to an aperture or to a spigot of the air distribution unit. This advantageously allows fresh air, such as air taken from outside a building, to be mixed with the conditioned air to provide better indoor air quality in spaces to which the conditioned air is distributed.

In a particularly preferred embodiment the air distribution unit is the first of a plurality of air distribution units arranged in a side-by-side configuration, such that air from the fresh air supply is provided through the first air distribution unit to each of the plurality of air distribution units via the delivery feature of each air distribution unit. This provides a system capable of conditioning and distributing large quantities of supplied air that is compact and occupies a minimum amount of space.

BRIEF DESCRIPTION OF THE DRAWINGS

The above-mentioned and other features of the various embodiments of the present invention will now be described, by way of example only and with reference to the accompanying drawings, in which.

DETAILED DESCRIPTION OF THE PREFERRED EMBODIMENTS

The principles of the present invention can be incorporated within any suitable air conditioning system. Examples of such suitable systems include HVAC systems, cooler fan systems, air extracting fan systems and the like. For ease of explanation, the description hereafter will be in terms of a plurality of adjacent air distribution units with a fresh air duct suitable, in conjunction with a plurality of fan coil units, for providing conditioned, cooled air to offices in a building.

Figure 1:
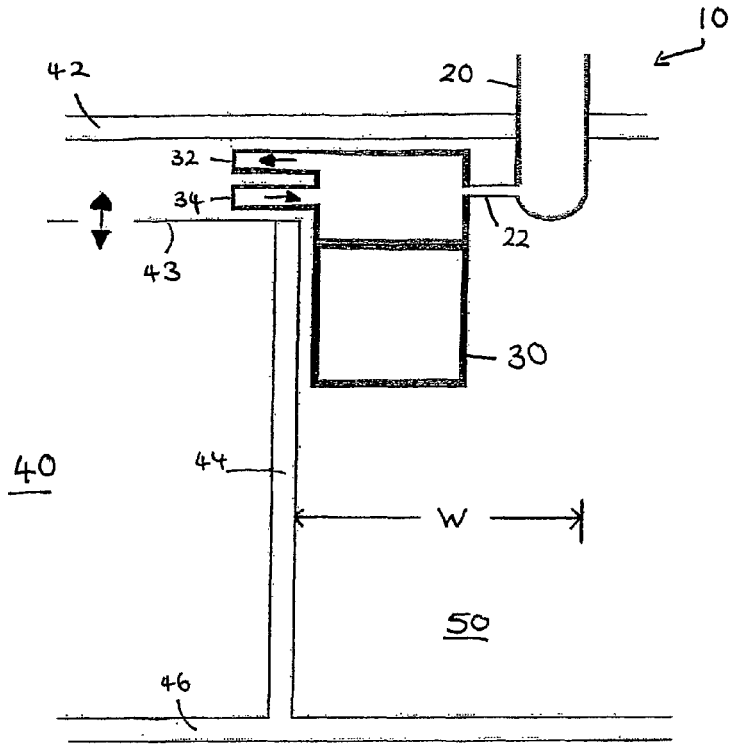
Figure 1 PRIOR ART
FIG. 1 shows a side view of a prior art air distribution system in a building.
Figure 2:
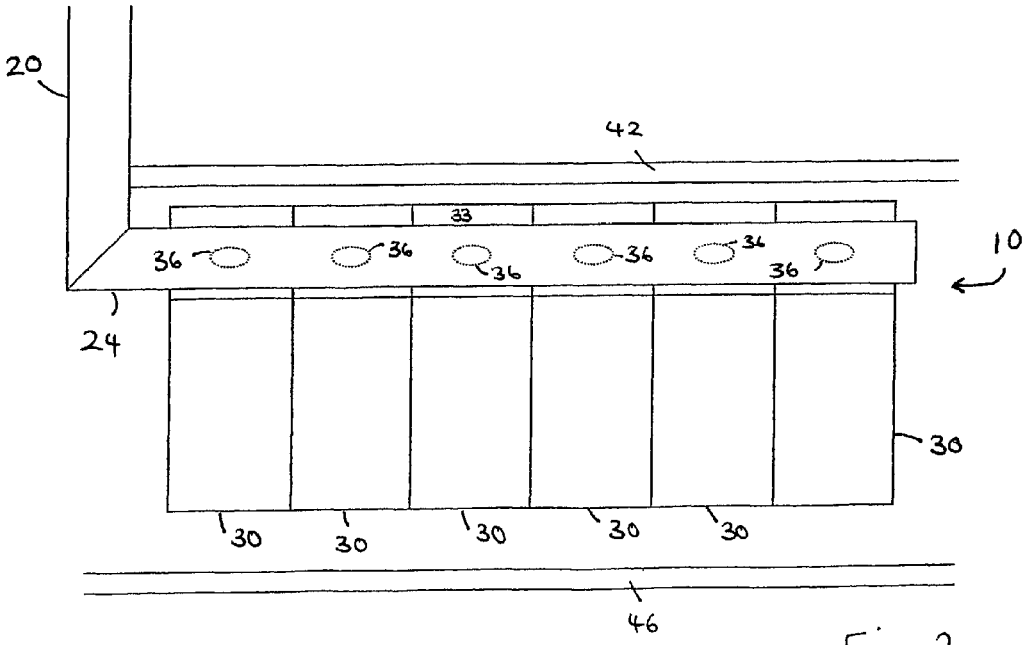
Figure 2 PRIOR ART
FIG. 2 shows a rear view of the air distribution installation of FIG. 1.

With reference to FIGS. 1 and 2, a typical prior art air distribution system 10 is shown installed in an office building 40. The system includes a fresh air duct 20, which is connected to an external air supply (for example the duct may run through the building and open to the air outside the building). The system further includes a plurality of air distribution units 30, each unit having an air supply outlet 32 for supplying air from the air distribution unit 30 to a duct (not shown) for distributing the air to an office space 40 (either directly, or for example via a boot as is known in the art). The air distribution units also have an air return inlet 34 for returning air from the office space 40 to the air distribution unit 30 for recycling, cooling, etc.

In order for fresh air to be mixed with the returned air, the fresh air must be supplied to each of the air distribution units 30. As can be seen from FIG. 2, the air distribution units 30 are installed side-by-side in order to minimize the space occupied by the plurality of units 30. Therefore, in order to provide fresh air from the fresh air duct 20 to each air distribution unit 30, smaller fresh air ducts 22 are provided, each operably connected to an opening 36 in the rear face 33 of each air distribution unit 30. As can be seen from FIG. 2, this arrangement further requires a large fresh air duct section 24 to run parallel with the back faces of the air distribution units 30 to provide fresh air to each of the smaller air ducts 22. As seen from FIG. 1, the air distribution system 10 is installed in a dedicated technical space 50, which may be adjacent or some distance from the office space 40 to be conditioned. A false ceiling 43 is installed beneath the building ceiling 42 for air distribution and a partition wall 44 is installed from the false ceiling 43 to the floor 46 to separate the dedicated space 50 from the office 40. The dedicated space 50 must be at least wide enough to accommodate the depth of the air distribution units 30 and the fresh air duct 20 and the smaller ducts 22. Therefore a minimum width W is required, resulting in an office space that is at least dimension W smaller than the actual space available in the building. Typically in an installation of this kind, W would be approximately 1500 mm.

Figure 3:
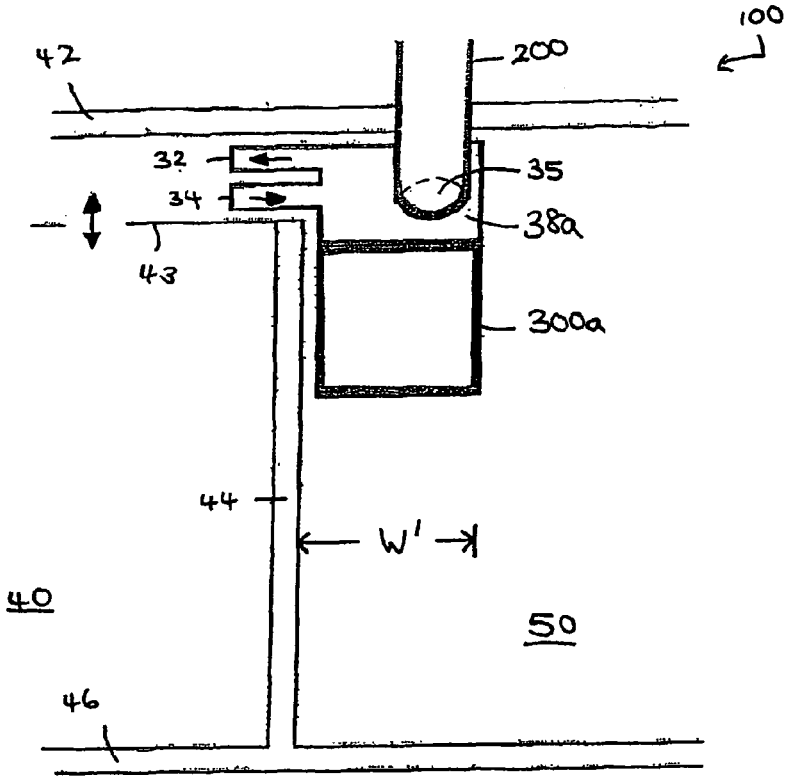
FIG. 3 shows a side view of an air distribution system in accordance with the present invention in a building similar to the building of FIG. 1.
Figure 4:
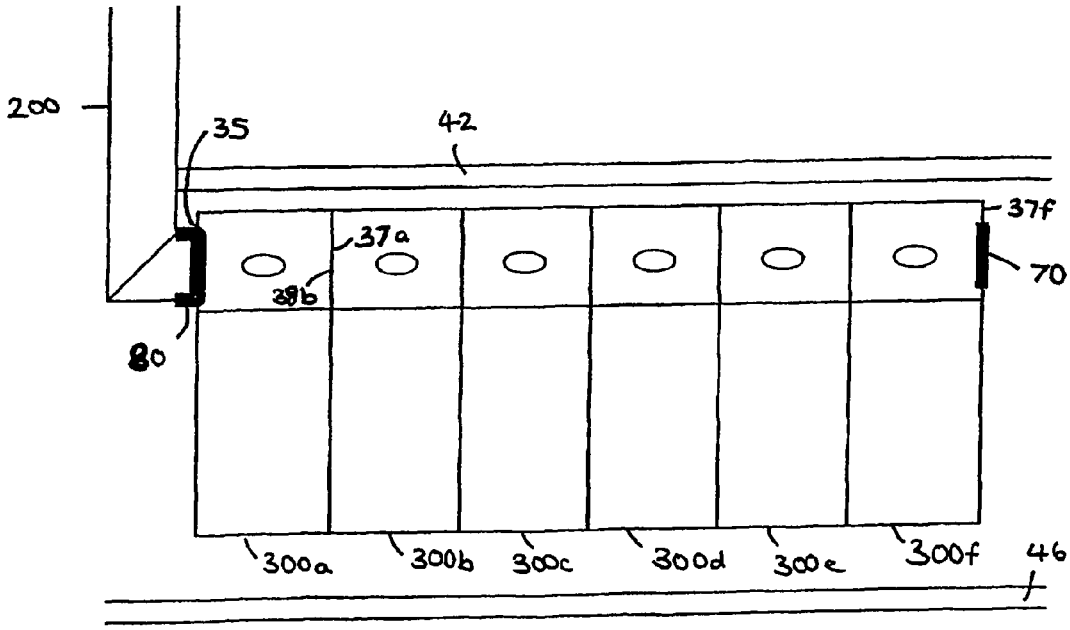
FIG. 4 shows a rear view of the air distribution installation of FIG. 3.

Turning to FIGS. 3 and 4, an air distribution system in accordance with an embodiment of the present invention is shown. Like reference numerals are used where appropriate for comparison with the prior art system shown in FIGS. 1 and 2. As can be seen in FIG. 3, fresh air duct 200 is connected to a first side face or wall 38*a* of the first air distribution unit 300*a*. This is achieved by connecting the fresh air duct directly to an aperture or spigot 35 in side wall 38 of the air distribution unit 300*a*. Therefore no separate small air ducts 22 are required for this embodiment of the present invention nor is there any need for the large fresh air duct section 24 of the prior art system. The aperture or spigot 35 acts as a delivery feature for receiving air from the fresh air duct 200 into the air distribution unit 300*a*. As shown in FIG. 4, the fresh air duct 200 is connected to the air distribution unit 300*a* by a seal 80. As the aperture or spigot 35 in the side wall 38 of the air distribution unit can be of any suitable shape and size (in this embodiment, the aperture is generally rectangular) the seal can be selected to be any shape or size as appropriate.

Each air distribution unit 300*a*, 300*b*, 300*c*, 300*d*, 300*e*, 300*f* of this embodiment includes at least two delivery features (not shown), with one being on the first side wall 38 of each unit and the second being on the opposite side wall 37 of each unit. In the present embodiment, the delivery features include generally rectangular openings 35 having spigots (not shown) associated therewith.

First air distribution unit 300*a* is adjacent only one further air distribution unit 300*b*. Each further air distribution unit 300*b*, 300*c*, 300*d*, 300*e* has an adjacent air distribution unit on either side. Final air distribution unit 300*f*, like first air distribution unit 300*a*, is adjacent only one other air distribution unit 300*e*. Therefore, since final air distribution unit 300*f* has two delivery apertures 35 like the other air distribution units 300*a*, 300*b*, 300*c*, 300*d* and 300*e*, the aperture in the second side wall 37*f* is open to the dedicated space 50. In order to provide a substantially air-tight channel through the air distribution units, cap 70 is placed into and over aperture 35 in sidewall 37*f* of final air distribution unit 300*f*.

By having an air distribution system in accordance with the above embodiment of the present invention, the depth of the system is significantly reduced, typically by up to about 40% compared with the depth of prior art systems such as the system of FIGS. 1 and 2. Therefore the width W' required to accommodate the air distribution system of the preferred embodiment of the present invention described above is also significantly reduced, for example to about 900 mm. Furthermore, less material is required for constructing the fresh air supply of the embodiment of the present invention, since no smaller ducts 22 or large duct section 24 are required and therefore the system of the embodiment is less expensive and quicker and simpler to install than prior art systems.

Figure 5:
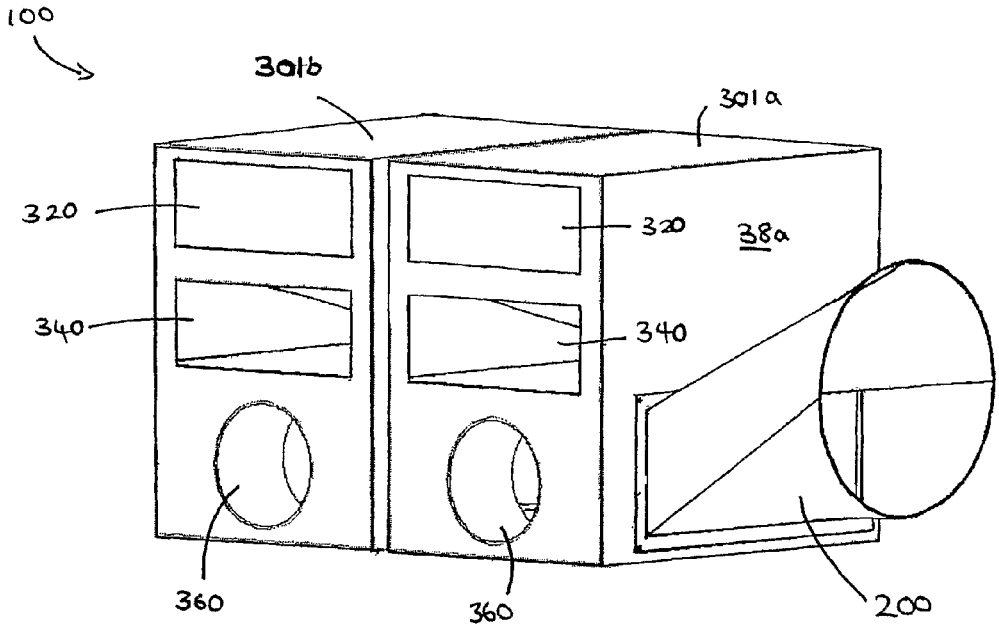
FIG. 5 shows an enlarged perspective view of two air distribution units of an alternative embodiment of the present invention, illustrating a fresh air duct end.
Figure 6:
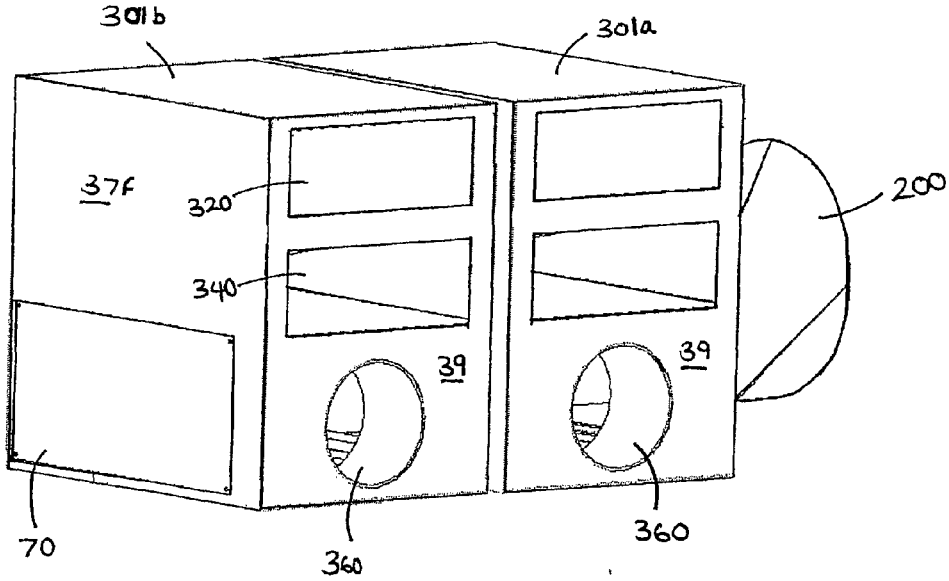
FIG. 6 shows an enlarged further perspective view of the two air distribution units of FIG. 5, illustrating a capped end.
Figure 7:
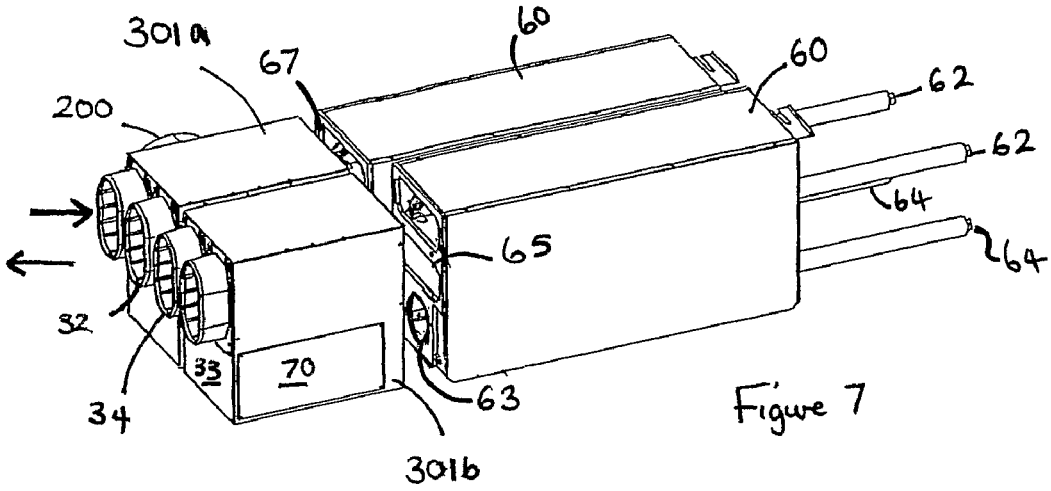
FIG. 7 shows a side perspective view of the two air distribution units of FIGS. 5 and 6 coupled with two fan coil units for use in an air conditioning system.
Figure 8:
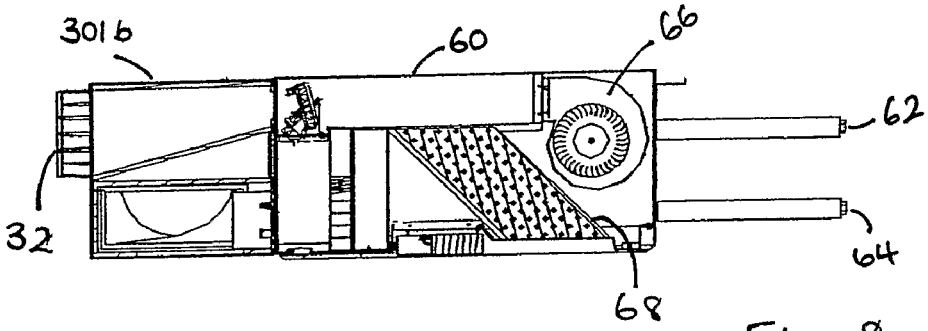
FIG. 8 shows a cross-section of one of the air distribution units and the fan coil units of FIG. 7.
Figure 9:
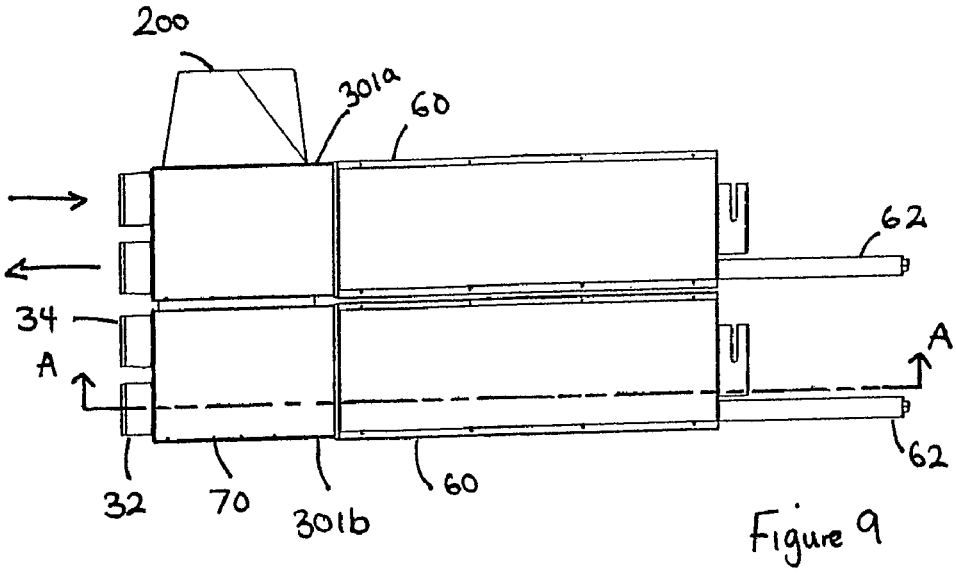
FIG. 9 shows a top view of the air distribution units and the two fan coil units of FIGS. 7 and 8.

A further embodiment of the present invention is shown in FIGS. 5 and 6 and is shown in conjunction with a pair of fan coil units in FIGS. 7, 8 and 9. Air distribution units 301*a* and 301*b* are shown, each air distribution unit having a fan coil supply duct 320, a fan coil return duct 340 and a fan coil fresh air supply duct or spigot 360 extending inwardly from a front face 39 thereof. These ducts are provided for operably connecting each air distribution unit 301*a*, 301*b* to a fan coil unit 60 (as shown in FIGS. 7, 8 and 9). Air distribution units 301*a*, 301*b* also have a supply air outlet 32 and a return air inlet 34 (FIGS. 7, 8 and 9) on the rear face 33 for supplying air to and receiving air from an office that is to be conditioned. As can be seen from FIGS. 7, 8 and 9, the air distribution units 301 are connected to the fan coil units 60 and a fresh air supply 200 is connected to one of the air distribution units 301*a*. Fresh air from the fresh air supply 200 therefore passes through the first air distribution unit 301*a* via the aperture in the side wall of the unit and into the second air distribution unit 301*b* via a second aperture (which is directly adjacent a first aperture in the side wall of the second air distribution unit 301*b*) and also into both fan coil units 60 via the air supply ducts or spigots 360 which are directly adjacent corresponding air supply ducts 63 of the fan coil units. The fresh air is, however, prevented from flowing through the second aperture of the second air distribution unit 301*b* by cap 70 which provides an air-tight seal. The fresh air provided to the fan coil units 60 is mixed with return air provided from the air conditioned office (which is supplied to the fan coil units 60 via the return air inlets 34 of the air distribution units 301*a*, 301*b* that are coupled via associated inlets 65 in the fan coil units 60) and passed through the coils 68 of the fan coil units 60 by the fans 66 of the fan coil units 60. The fan coil units comprise water coil inlets 64 and outlets 62 for cooling and/or heating the coil. Thereafter, the conditioned air is passed from the fan coil units 60 via the air distribution units 301*a*, 301*b* by associated fan coil supply air outlets 67 and air distribution unit outlets 32 to the office space which is to be conditioned.

It will be appreciated that details of the foregoing embodiments, given for purposes of illustration, are not to be construed as limiting the scope of this invention. Although only a few exemplary embodiments of this invention have been described in detail above, those skilled in the art will readily appreciate that many modifications are possible in the exemplary embodiments without materially departing from the novel teachings and advantages of this invention. For example, whilst some of the above embodiments are described with reference to fan coil units, this is not intended to be limiting and the present invention is also applicable with other air conditioning systems and the like. Furthermore, features described in relation to those embodiments not associated with fan coil units are intended to be combined with embodiments associated with fan coil units. Other arrangements are also envisaged, for example, the air supply outlets and return air inlets of the various embodiments need not be incorporated in the air distribution units, but may rather form part of another unit such as the fan coil unit or a further, possibly dedicated unit. Furthermore, the air distribution units and fan coil units need not be provided as separate units, but could instead comprise an integrated distribution and cooling system. Accordingly, all such modifications are intended to be included within the scope of this invention, which is defined in the following claims.

The invention claimed is:

1. An air distribution system for an air conditioning system, the air distribution system comprising:

a plurality of air distribution units arranged in a side-by-side configuration, wherein each air distribution unit includes a delivery feature such that air from an air supply is deliverable through the air distribution unit and into an adjacent air distribution unit, wherein at least one of the plurality of air distribution units includes:

a housing having a first face and a second face opposite the first face, and a side wall between the faces, a supply air outlet and a return air outlet provided at the first face, a fan coil supply duct for delivering conditioned air, a fan coil return duct for returning recirculated air to the fan coil unit, and a fan coil air supply duct opening for providing fresh air to the fan coil unit through the second face, and an air supply provided in the side wall; and a respective fan coil unit operably coupled with each air distribution unit by an air supply feature for supplying the air from the air supply to the fan coil unit via the air distribution unit, wherein the fan coil unit coupled to the air distribution unit includes:

a third face arranged face to face with the second face of the air distribution unit, an air supply inlet in communication with the air supply duct of the air distribution unit, a return air inlet in communication with the fan coil return duct of the air distribution unit, and a supply air outlet in communication with the fan coil supply duct, wherein the air supply inlet, the return air inlet, and the supply air outlet open through the third face.

2. The air distribution system of claim 1, wherein the air supply is operably connected to at least one of the plurality of air distribution units.

3. The air distribution system of claim 1, wherein a spigot is associated with the fan coil supply duct.

4. The air distribution system of claim 3, wherein an airflow control is provided in the spigot for controlling a flow of air between the air distribution unit and the fan coil unit.

5. The air distribution system of claim 2, wherein the air supply supplies unconditioned air from a source external to the air distribution system to the plurality of air distribution units.

6. The air distribution system of claim 2, wherein the air supply is operably connected to only one of the plurality of air distribution units.

7. The air distribution system of claim 6, wherein the air supply is operably connected to a first air distribution unit having only one adjacent air distribution unit in the side-by-side configuration.

8. The air distribution system of claim 7 wherein the air supply is operably connected to a first side of the first air distribution unit, the first side being opposite a second side of the first air distribution unit and the second side being operably connected by the delivery feature to the adjacent air distribution unit.

9. The air distribution system of claim 2, comprising a seal for providing a substantially air-tight connection between the air supply and the delivery feature of the plurality of air distribution units.

10. The air distribution system of claim 2, including a closure feature for providing a substantially air-tight closure for the delivery feature of at least one of the plurality of air distribution units.

11. The air distribution system of claim 10, wherein the closure feature comprises a cap.

12. The air distribution system of claim 2, comprising a seal for providing a substantially air-tight connection between the air supply and the delivery feature of a first air distribution unit of the plurality of side-by-side air distribution units and a cap for providing a substantially air-tight closure for the delivery feature of a last air distribution unit of the plurality of air distribution units to provide a channel from the air supply through the air distribution units.

13. The air distribution system of claim 1, wherein the delivery feature of the air distribution unit comprises an aperture provided in one side wall of the air distribution unit and a further aperture provided in an opposite side wall of the air distribution unit.

14. A method of providing conditioned air to a space to be conditioned, the method comprising the steps of:

providing air from an air source to an aperture in a side wall of an air distribution unit, wherein the air distribution unit is a first unit in a plurality of air distribution units arranged in a side-by-side configuration, each of the plurality of air distribution units having a further aperture disposed in each side wall that lies adjacent another air distribution unit;

providing the air in the plurality of air distribution units from the air source to a plurality of fan coil units operably associated with the air distribution units and conditioning the air in the fan coil units;

distributing the conditioned air from the fan coil units via the distribution units to the space to be conditioned; and receiving return air from the space to be conditioned at the air distribution units, wherein further air provided by the air source is mixed with the return air and the mixed air is conditioned in the fan coil units as the method is repeated;

wherein at least one of the air distribution units includes:

a housing having a first face and a second face opposite the first face, and a side wall between the faces, a supply air outlet and a return air outlet provided at the first face, a fan coil supply duct for delivering conditioned air, a fan coil return duct for returning recirculated air to the fan coil unit, and a fan coil air supply duct opening for providing fresh air to the fan coil unit onto the second face, and an air supply provided in the side wall, and wherein the fan coil unit coupled to the at least one of the air distribution units includes:

a third face arranged face to face to the second face of the air distribution unit, an air supply inlet in communication with the air supply duct of the air distribution unit, a return air inlet in communication with the fan coil return duct of the air distribution unit, a supply air outlet in communication with the fan coil supply duct, wherein the air supply inlet, the return air inlet, and the supply air outlet open through the third face.

* * * * *